United States Patent [19]

Kishi

[11] Patent Number: 4,982,853

[45] Date of Patent: Jan. 8, 1991

[54] REINFORCEMENT MECHANISM FOR MULTI-STAGE TELESCOPIC BOOM

[75] Inventor: Mitsuhiro Kishi, Ashikaga, Japan

[73] Assignee: Hikoma Seisakusho Co., Ltd., Japan

[21] Appl. No.: 335,201

[22] Filed: Apr. 7, 1989

[30] Foreign Application Priority Data

Feb. 9, 1989 [JP] Japan ..... 64-32401
Feb. 9, 1989 [JP] Japan ..... 64-32402

[51] Int. Cl.[5] ..... B66C 23/42

[52] U.S. Cl. ..... 212/231; 212/186; 212/230; 212/264

[58] Field of Search ..... 212/186, 230, 264, 266, 212/267, 268, 269, 231; 182/2; 52/118

[56] References Cited

U.S. PATENT DOCUMENTS

| | | | |
|---|---|---|---|
| 3,534,867 | 10/1970 | Johnston | 212/264 |
| 3,638,806 | 2/1972 | Hippach | 212/231 |
| 4,363,413 | 12/1982 | Gyomrey | 212/267 |
| 4,492,312 | 1/1985 | Poock | 212/264 |
| 4,523,669 | 6/1985 | Smith | 212/231 |

*Primary Examiner*—Sherman Basinger
*Assistant Examiner*—Thomas J. Brahan
*Attorney, Agent, or Firm*—Bruce L. Adams; Van C. Wilks

[57] ABSTRACT

A multi-stage boom having a plurality of boom members including a first boom member, at least one intermediate boom member and a last boom member, each being slideably inserted into its subordinate boom member to undergo telescopic expansion and contraction. An operating shaft is connected pivotably at its bottom portion erectly to a peripheral lower end portion of the last boom member, and a plurality of adjusting shafts are each disposed pivotably at its bottom portion erectly to a peripheral upper end portion of each boom member except the first boom member. A first tension cable is connected at its one end to a lower end portion of the first boom member, lead therefrom through an upper end opening of a subordinate boom member, turned forwardly at a top portion of an adjusting shaft disposed at a peripheral upper end portion of the subordinate boom member, and connected at its other end to an upper end portion of the first boom member. At least one intermediate tension cable is connected at its one end to a lower end portion of a corresponding intermediate boom member, lead therefrom through an upper end opening of a subordinate boom member, turned forwardly at a top portion of an adjusting shaft disposed on a peripheral upper end portion of the subordinate boom member, and connected at its other end to a top portion of another adjusting shaft disposed on a peripheral upper end portion of the corresponding intermediate boom member. A last tension cable is connected between a top portion of the operating shaft and a top portion of an adjusting shaft disposed on a peripheral upper end portion of the last boom member. A control mechanism controls tilting angle of the operating shaft according to expansion amount of the multi-stage boom to tension a chain of the first, intermediate and last tension cables.

5 Claims, 9 Drawing Sheets

REINFORCEMENT MECHANISM FOR MULTI-STAGE TELESCOPIC BOOM

BACKGROUND OF THE INVENTION

1. Field of the Invention

The present invention relates to a telescopic multi-stage boom used in a crane which shifts a hook up and down to lift a weight load, and used in an elevating device which shifts an elevating stand up and down above a vehicle body to lift a person or material. More specifically, the present invention relates to a reinforcement mechanism of the multi-stage boom, the mechanism being provided with flexible cables for supporting a part of a weight load applied to a top end portion of the multi-stage boom so as to avoid the multi-stage boom from bending.

2. Prior Art

There is known and frequently used a lifting mechanism including a crane mounted on a vehicle such as a truck and operable to lift a weight load so as to load and unload cargos.

There is also known and frequently used an elevating working station vehicle provided with an elevating station for use in assembling, painting and repairing work at high places such as highways and building constructions. The elevating station may accommodate workers and materials to transport them between the ground and elevated level.

These conventional crane and elevating working station vehicles are often provided with a multi-stage boom comprised of booms having different outer diameters and each being telescopically inserted into the other to undergo extension and contraction in their lengthwise direction.

This multi-stage boom has a very short total length in the most contracted state and a very long total length in the most extended state, and therefore is frequently installed on a crane vehicle and elevating or high working station vehicle which have a limited total length of vehicle body, because the multi-stage boom has the advantage that the multi-stage boom can be most contracted in compact size during the travel of vehicles.

However, since the multi-stage boom mechanism is comprised of a plurality of booms having different outer diameters and being telescopically connected to each other, there are many sliding contact portions in the mechanism. For this reason, there are drawbacks such as excessive play may be produced during the course of long time operation and such as the top end portion of the boom mechanism may swing up and down when extended longer or when lifting a heavier weight load. Consequently, in order to lift a heavy weight load, each boom must be physically strengthened, resulting in increase of the total weight of the multi-stage boom. Further, since each boom is made of metal, when a heavy weight load is applied to the top end of the multi-stage boom, the multi-stage boom is bent due to the heavy weight load and deformed in arch shape. Therefore, when the multi-stage boom lifts a heavy weight load, the multi-stage boom sometimes cannot be smoothly slided in the lengthwise direction thereof.

As described above, while the conventional multi-stage boom has a very short total length when most contracted, it has the drawback that each boom must be physically strengthened and made in rigid shape in order to withstand against an applied heavy weight load, thereby causing increase in the total weight. Further, each boom may be bent when applied with a weight load. In such case, sliding contact portion between adjacent booms must be accurately shaped to enable the smooth sliding even under bent state and therefore very high accuracy is required in shaping each boom.

SUMMARY OF THE INVENTION

In order to solve the above-mentioned problem of the conventional structure, an object of the present invention is to provide a reinforcement mechanism comprised of flexible cables for supporting a part of the weight load so as to avoid bending of the multi-stage boom.

In a multi-stage boom having a plurality of boom members including a first or top boom member, at least one intermediate boom member and a last or bottom boom member, each being slideably inserted into its subordinate boom member to undergo telescopic expansion and contraction, according to the present invention, the improvement comprises an operating shaft connected pivotably at its bottom portion erectly to a peripheral lower end portion of the last boom member and a plurality of adjusting shafts, each being disposed pivotably at its bottom portion erectly to a peripheral upper end portion of each boom member except the first boom member. A first tension cable is connected at its one end to a lower end portion of the first boom member, lead therefrom through an upper end opening of a subordinate boom member, turned forwardly at a top portion of an adjusting shaft disposed at a peripheral upper end portion of the subordinate boom member, and connected at its other end to an upper end portion of the first boom member. At least one intermediate tension cable is connected at its one end to a lower end portion of a corresponding intermediate boom member, lead therefrom through an upper end opening of a subordinate boom member, turned forwardly at a top portion of an adjusting shaft disposed on a peripheral upper end portion of the subordinate boom member, and connected at its other end to a top portion of another adjusting shaft disposed on a peripheral upper end portion of &he corresponding intermediate boom member. A last tension cable is connected between a top portion of the operating shaft and a top portion of an adjusting shaft disposed on a peripheral upper end portion of the last boom member. A control mechanism controls the tilting angle of the operating shaft according to the entire length of the multi-stage boom to tension a chain of the first, intermediate and last tension cables.

In operation, when each individual boom member is slideably drawn from its subordinate boom member, the corresponding tension cable is also drawn from the upper end opening of the subordinate boom member through its adjusting shaft at the same length as that of the the expansion distance of individual boom member so as to pull up the upper end portion of the first or uppermost boom member through a chain of the tension cables. Namely, by adjusting or changing the tilting angle of the operating shaft mounted on the last boom member according to the expansion distance, the upper end portion of the first boom member is pulled upwardly by means of subsequently connected tension cables so that the multi-stage boom can be prevented from bending due to an applied weight load and can be always maintained linearly. Further, the control mechanism controls the tilting angle of the erected operating shaft dependantly of the expansion length of multi-stage boom so as to maintain an isosceles triangle relation among the first tension cable, the adjusting shaft engaged with the first tension cable and the exposed length of the first boom member to thereby suppress the bending strain along upper-lank boom members.

Stated otherwise, since the multi-stage boom is pulled by the tension cables in the direction opposite to the bending direction thereof, the multi-stage boom is always supported in the direction opposite to the application direction of the weight load to thereby reduce the stress applied to the multi-stage boom. Accordingly, the multi-stage boom is not bent by the weight load, and the plural boom members thereof are always aligned linearly to facilitate the smooth sliding movement thereof. Further, the needed physical strength of individual boom members can be reduced as compared to the conventional structure to thereby reduce total weight of the multi-stage boom.

DETAILED DESCRIPTION OF THE INVENTION

Figure 1:
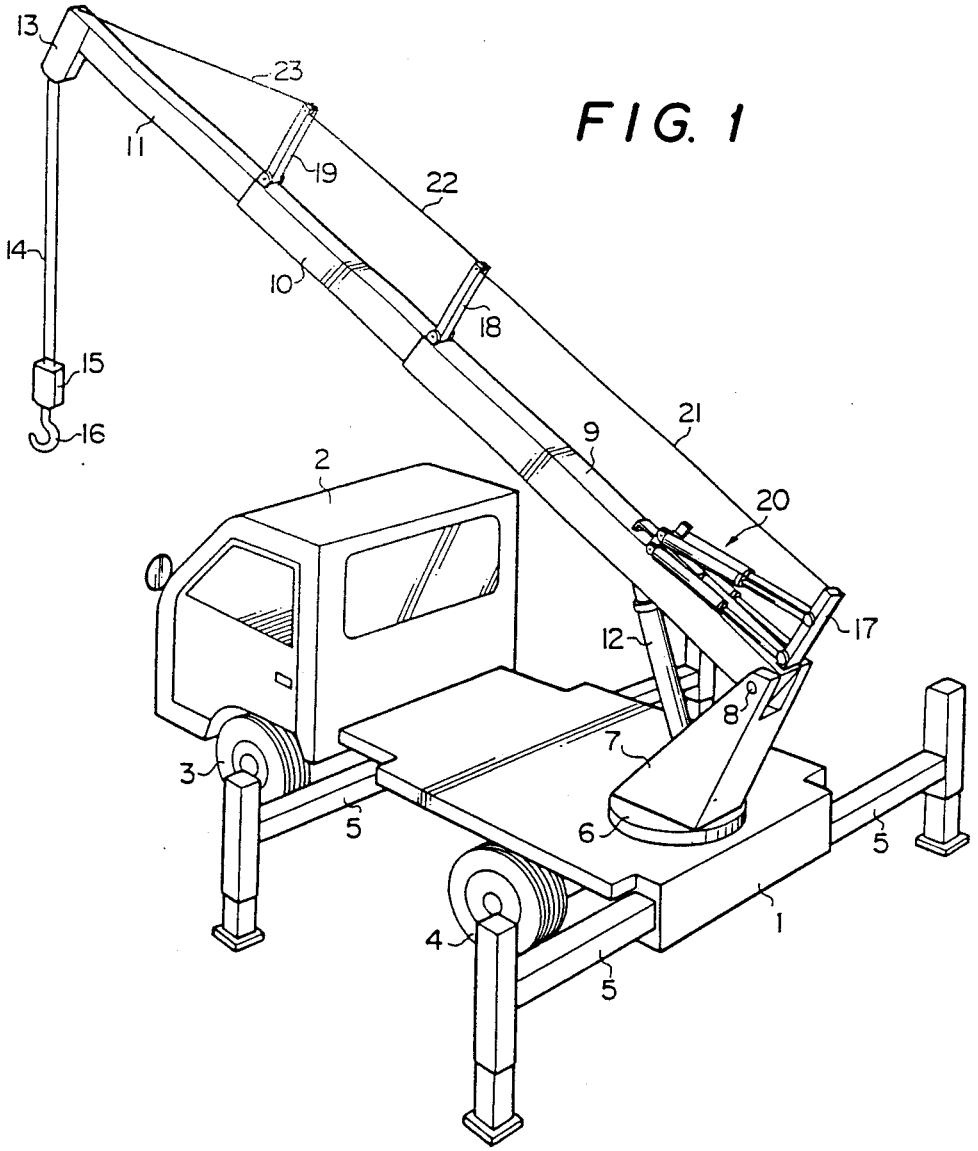
FIG. 1 is a perspective view of a crane vehicle provided with one embodiment of multi-stage boom according to the present invention.

Hereinafter, preferred embodiments of the present invention will be explained in conjunction with the attached drawings. Referring to FIG. 1 which shows a crane vehicle provided with one embodiment of the inventive multi-stage boom, a vehicle body 1 which accommodates therein an engine etc. has on its front area a cabin 2 which accommodates therein an operator, and front and rear driving wheels 3 and 4 rotationally mounted, respectively, on front and rear portions of the vehicle body The vehicle body 1 is further provided with four outriggers 5 extending outwardly widthwise of the body at both sides thereof so as to fix the vehicle body 1 in place. A turn table 6 is mounted on a rear part of the body upper face turnably along a horizontal plane. A support frame 7 is fixed to the top face of the turn table 6. A bottom or last boom member 9 is pivotably connected to a top portion of the support frame 7 by means of a pivot pin 8. An intermediate boom member 10 is slideably inserted into an upper end opening of the last boom member 9. A top or first boom member 11 is slideably inserted into an upper end opening of the intermediate boom member 10. These first, intermediate and last boom members 11, 10 and 9 constitute the multi-stage boom mechanism operable to undergo expansion and contraction in the lengthwise direction thereof.

A hydraulic cylinder 12 is interposed between the support frame 7 and the bottom side of last boom member 9 to control the elevating angle of the boom mechanism. A head 13 is attached to an upper end portion of the first boom member 11. A suspension wire 14 is connected to the head 13 downwardly therefrom, and a hook body 15 and a hook member 16 are connected to the free end of the suspension wire 14. An operating shaft 17 is pivotably and erectly mounted on a top side face or top periphery of the lower end portion of the last boom member 9. A control mechanism 20 is composed of four hydraulic cylinders and is connected to the operating shaft 17 so as to control or adjust the pivoting or tilting angle of the operating shaft 17

Further, an adjusting shaft 18 is pivotably and erectly mounted on the top side face of the upper end portion of the last boom member 9, and another adjusting shaft 19 is pivotably and erectly mounted on the top side face of the upper end portion of the intermediate boom member 10. A last tension wire 21 is engaged and extended between the top portion of operating shaft 17 and the top portion of the adjacent adjusting shaft 18. An intermediate tension cable in the form of a tension wire 22 is connected at its one end to the top portion of the adjusting shaft 19. The wire 22 extends rearwardly from the top portion of the adjusting shaft 19 and is turned downwardly at the top portion of the adjacent adjusting shaft 18, then lead through the upper end portion of the subordinate last boom member 9 into the inside thereof, and finally connected at its other end to the lower end portion of the intermediate boom member 10 inside the last boom member 9. In addition, a first tension cable in the form of a tension wire 23 is connected at its one end to the upper end portion of the first boom member 11. The wire 23 extends rearwardly from the upper end portion of &he first boom member 11 and is turned downwardly at the top portion of the adjusting shaft 19, then lead through the upper end opening of the subordinate intermediate boom member 10 into the inside thereof, and finally connected at its other end to the lower end portion of the first boom member 11 inside the intermediate boom member 10.

Figure 2:
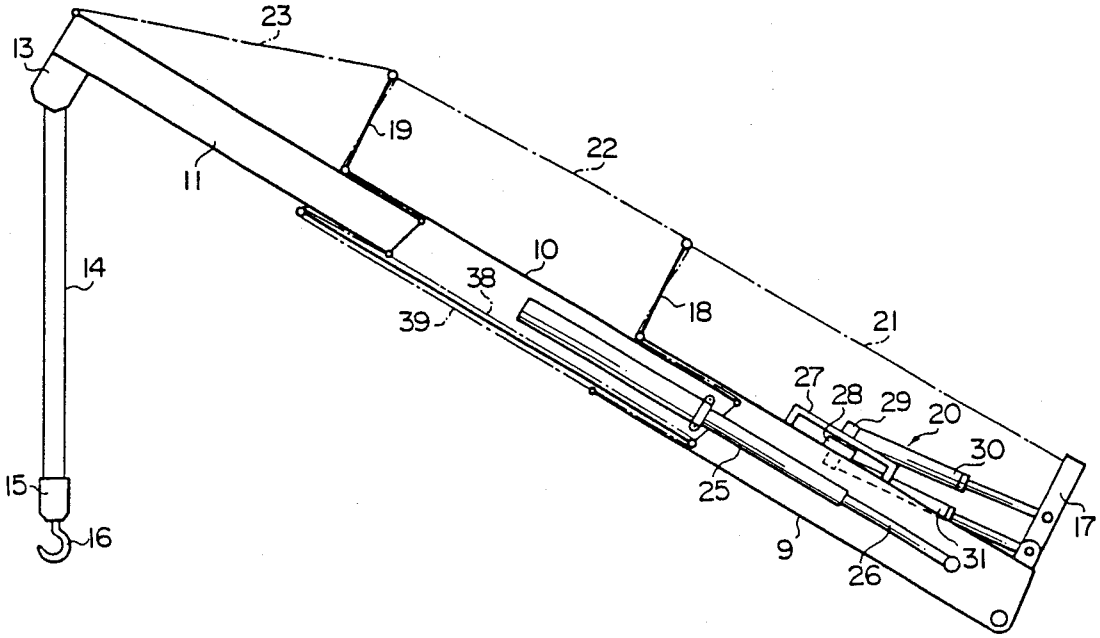
FIG. 2 is a sectional view showing the internal structure of the multi-stage boom shown in FIG. 1.

Referring to FIG. 2 which shows a detailed internal structure of the expansion boom mechanism, a hydraulic cylinder 25 is arranged lengthwisely inside the hollow intermediate boom member 10. A cylinder rod 26 of the hydraulic cylinder 25 extends rearwardly and is connected at its free end to the lower end portion of last boom member 9. Further, a synchronizing wire 38 is connected at its one end to the lower end of first boom member 11, extended rearwardly therefrom into the intermediate boom member 10, reversed forwardly at the lower end of intermediate boom member 10, and connected at its other end to the upper end of last boom member 9. Another synchronizing wire 39 is also connected at its one end to the lower end of first boom member 11, extended therefrom forwardly, then reversed rearwardly at the upper end of intermediate boom member and finally connected at its other end to the upper end of last boom 9. This pair of synchronizing wires 38 and 39 operates to synchronize the three boom members 9, 10 and 11 with each other during expansion and contraction such that the first boom member 11 can slide relative to the intermediate boom member 10 at the same speed as the intermediate boom member 10 slides relative to the last boom member 9.

A guide member 27 is fixed at a substantially center portion of the top side face of last boom member 9. The guide member 27 has "n" shape in cross section. A slider 28 is inserted into the inside space of guide member 27 and guided to displace in the lengthwise direction of last boom member 9. A connecting rod 29 is fixed to a widthwise side portion of the slider 28. A pair of hydraulic cylinders 30 and 31 are connected in parallel relation with each other to the connecting rod 29. The respective cylinder rods of hydraulic cylinders 30 and 31 are connected to the operating shaft 17 in vertically spaced relation to each other such that the pair of hydraulic cylinders 30 and 31 are spaced away like V-shape.

Figure 3:
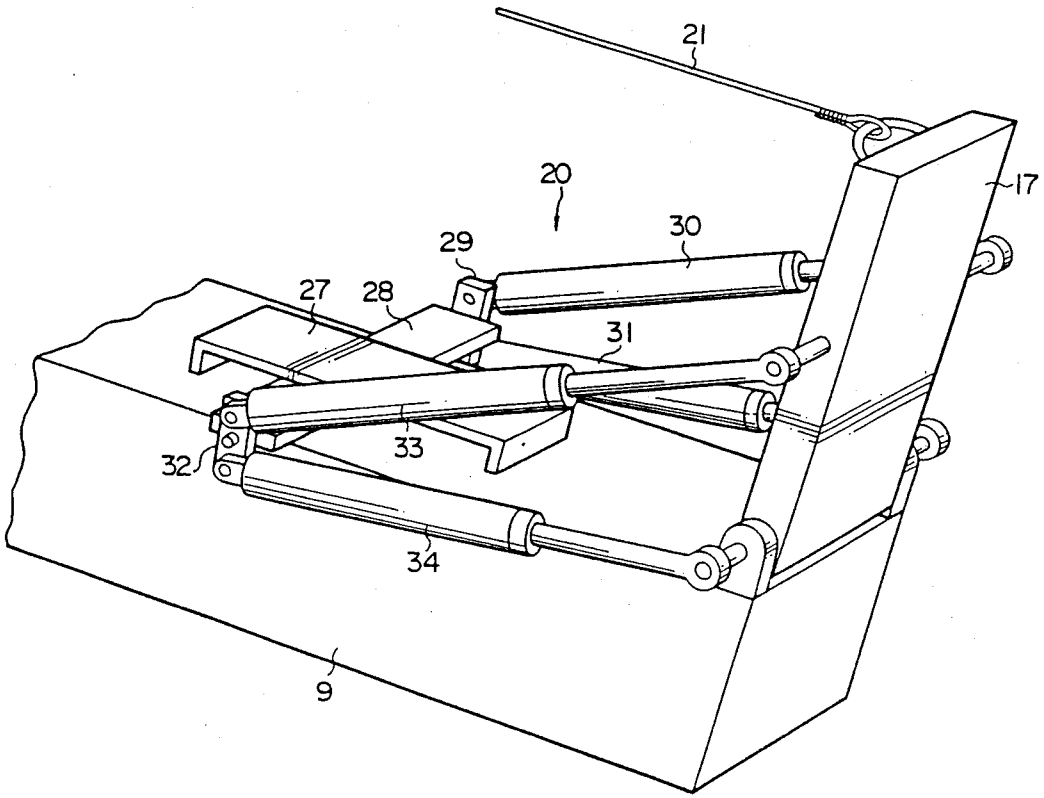
FIG. 3 is an enlarged perspective view showing a control mechanism of the multi-stage boom shown in FIG. 1.

Next referring to FIG. 3 which shows an enlarged view of the control mechanism 20, the slider 28 is inserted into the guide member 27, the axis of slider 28 is arranged normal to that of last boom member 9, and the slider 28 is slideable lengthwise of the last boom member 9. A pair of connecting rods 29 and 32 are fixed to widthwisely opposite sides of the slider 28. A pair of hydraulic cylinders 30, 31 are connected to the connecting rod 29, and another pair of hydraulic cylinders 33, 34 are connected to the other connecting rod 32. The cylinder rods of hydraulic cylinders 31 and 34 are, respectively, connected to opposite ends of a pivot pin positioned on the bottom portion of operating shaft 17. The cylinder rods of hydraulic cylinders 30 and 33 are, respectively, connected to opposite sides of the mid portion of the operating shaft 17 such that the two hydraulic cylinders 30 and 31 are arranged in a V-shape with the other two hydraulic cylinders 33 and 34.

Figure 4:
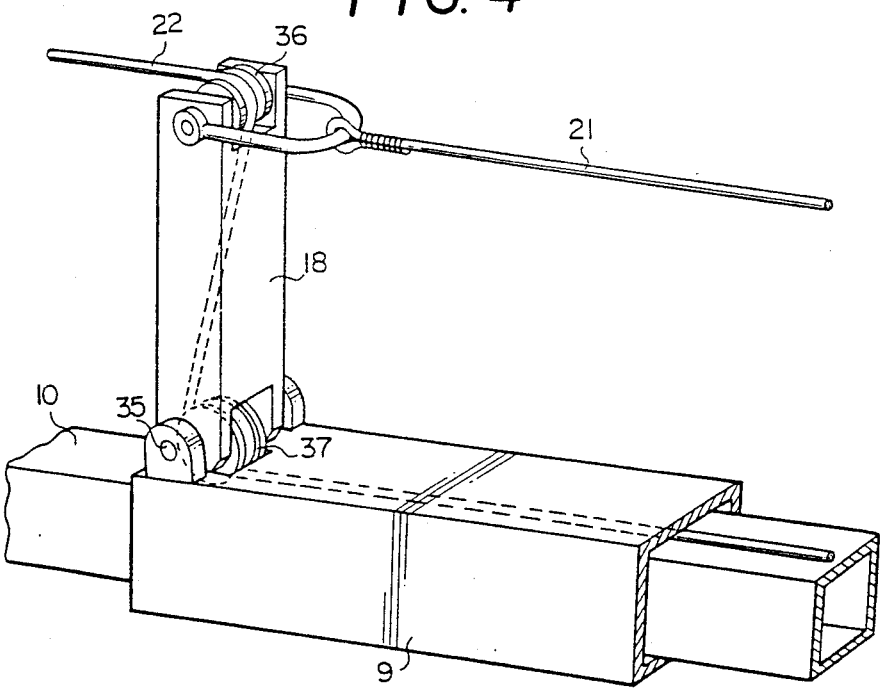
FIG. 4 is an enlarged perspective view showing the detailed structure of an adjusting shaft of the multi-stage boom shown in Fig 1.

Next referring to FIG. 4 which shows a detailed structure of the adjusting shaft 18 disposed at the upper end portion of last boom member 9, the adjusting shaft 18 is connected pivotably at its bottom portion to the top side face of the upper end portion of the last boom member 9 by means of a pivot pin 35 A pulley 36 is rotatably supported at the top portion of adjusting shaft 18 and another pulley 37 is rotatably supported at the bottom portion of adjusting shaft 18. The intermediate tension wire 22 is turned downwardly at the pulley 36, and then guided by the pulley 37 into the inside of last boom member 9 through the upper end opening thereof, and finally connected at its free end to the lower end portion of intermediate boom member 10 inside the last boom member 9.

Figure 5:
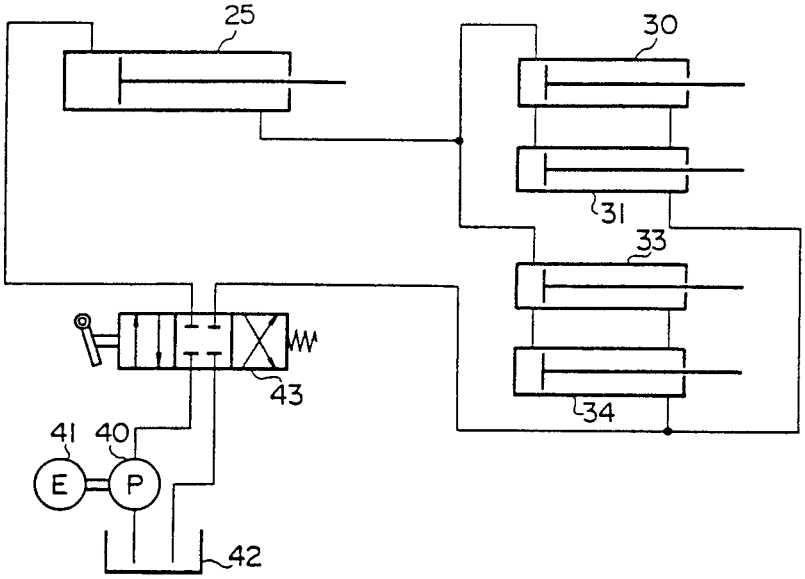
FIG. 5 is a block diagram of hydraulic system used in the multi-stage boom shown in FIG. 1.

FIG. 5 shows a block diagram of hydraulic system used in the present embodiment. FIG. 5 shows only a part relating to the drive of the multi-stage boom mechanism. A hydraulic pump 40 is driven by an engine 41, and connected at its inlet port to an oil tank 42 and connected at its outlet port to a switching valve 43. The switching valve 43 is connected at its discharge port to the oil tank 42. The output port of switching valve 43 is connected to the actuating hydraulic cylinder 25 operative to effect the expansion and contraction of the boom mechanism. The discharge port of hydraulic cylinder 25 is connected to the four controlling hydraulic cylinders 30, 31, 33 and 34 which are hydraulically arranged in parallel to each other. The discharge ports of the four hydraulic cylinders 30, 31, 33 and 34 are combined together and connected to the return port of switching valve 43.

Next, the operation of this embodiment will be explained hereinbelow. Firstly, the engine 41 is operated to drive the hydraulic pump 40. Then, the oil stored in the tank 42 is fed through the oil pump 40 to the switching valve 43 in the form of pressurized oil. When the switching valve 43 is switched forwardly, the pressurized oil is fed to the actuating hydraulic cylinder 25 to expand the same. At the same time, the pressurized oil discharged from the hydraulic cylinder 25 is fed to the respective controlling hydraulic cylinders 30, 31, 33 and 34 to concurrently expand them.

With regard to the expansion of the multi-stage boom, the actuating hydraulic cylinder 25 is expanded to protrude the cylinder rod 26 so that the intermediate boom member 10 is protruded from the last boom member 9. In response to the protrusion of intermediate boom member 10 from the last boom member 9, the pair of synchronizing wires 38 and 39 are pulled at the upper end of intermediate boom member 10 so as to simultaneously protrude the first boom member connected to the wires 38 and 39 from the upper end opening of intermediate boom member 10. Accordingly, the first and intermediate boom members 11 and 10 are synchronizingly and telescopically protruded from the last boom member 9 in unison with each other in response to the actuation of hydraulic cylinder 25.

At the same time, the intermediate tension wire 22 is drawn from the upper end opening of last boom member 9 in response to protrusion of the intermediate boom member 10 from the last boom member 9, and is extended through the top portion of adjusting shaft 18 in parallel to the intermediate boom member 10. In similar manner, when the first boom member 11 is protruded from the intermediate boom member 10, the first tension wire connected to the first boom member 11 is drain through the top portion of adjusting shaft 19 and is extended to define a triangle together with the first boom member 11 and the adjusting shaft 19.

Since the last tension wire 21 extended between the operating shaft 17 and the adjacent adjusting shaft 18 is always pulled rearwardly by the operating shaft 17, the chain of tension wires 21, 22 and 23 is always held in the tension state so as to pull upwardly the upper end portion of first boom member 11 in the direction opposite to the downward weight load. As described above, the four controlling hydraulic cylinders 30, 31, 33 and 34 are expanded in synchronization with the expansion of actuating hydraulic cylinder 25 through the hydraulic system. Accordingly, when the hydraulic cylinders 30, 31, 33 and 34 are expanded, the connecting rods 29 and 32 are pushed away from the operating shaft 17 so that the slider 28 is slideably displaced alongē the top side face of the last boom member 9. As a result, the pair of hydraulic cylinders 30 and 31 as well as the other pair of hydraulic cylinders 33 and 34 are linearly and angularly displaced to reduce the acute angle between each pair of the hydraulic cylinders so that the operating shaft 17 is pivoted around its bottom portion in the direction away from the axis of last boom member 9 toward the vertical position relative thereto to thereby operate to always pull the tension wire 21 rearwardly. Consequently, the adjusting shafts 18 and 19 linked to the tension wire 21 are also erected pivotably in synchronization with the angular displacement of operating shaft 17 so as to maintain the intermediate tension wire 22 in parallel to the axis of intermediate boom member 10 and so as to equalize the length of the first tension wire 23 between the upper end of first boom member 11 and the top portion of the adjusting shaft 19 to that of the protruded portion of first boom member 11. Namely, the upper end of first boom member 11, the top of adjusting shaft 19 end the bottom of adjusting shaft 19 are kept in isosceles triangle relation during the expansion and contraction of the boom mechanism.

Figure 6:
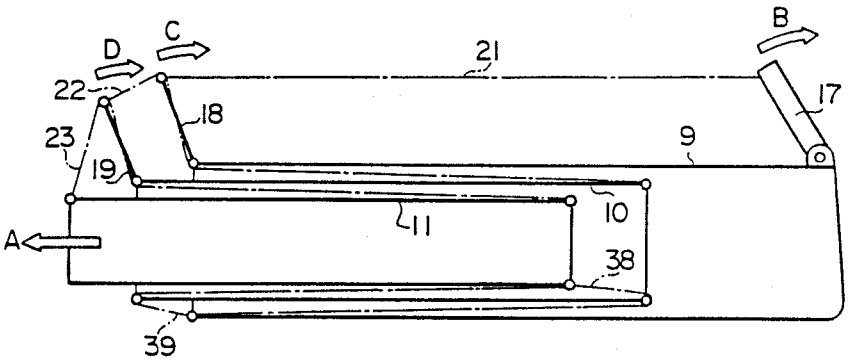
FIG. 6 is a schematic view showing the most contracted state of the multistage boom.
Figure 7:
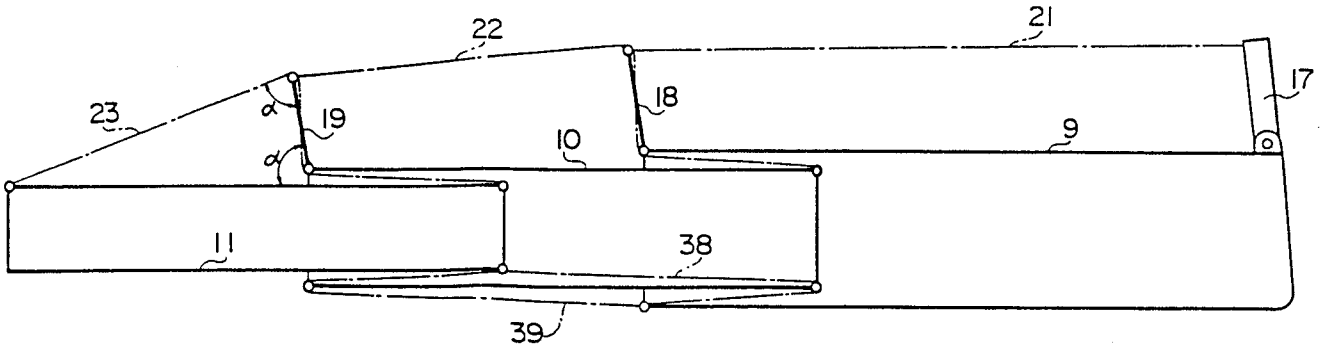
FIG. 7 is another schematic view showing greatly expanded state of the multi-stage boom.

FIGS. 6 and 7 show co-operation states of the multi-stage boom mechanism and the reinforcement mechanism including the chain of tension wires 21, 22 and 23. Referring to FIG. 6 which shows the most contracted state of the multi-stage boom, the operating shaft 17 as well as the adjusting shafts 18 and 19 are inclined leftward in the figure, and the wire 23 operates to pull upwardly the upper end of first boom member 11. By driving the actuating bydraulic cylinder 25, the intermediate boom member 10 and the first boom member 11 are protruded telescopically from the last boom member 9 in the manner described above to expand forwardly in the direction indicated by arrow A in the figure. Since the protruding length of first boom member 11 is always identical to that of intermediate boom member 10, the drawn lengths of tension wires 22 and 23 are identical to each other. While the intermediate boom member 10 and the first boom member 11 are protruded from the last boom member 9, the operating shaft 17 is pivotably erected in the direction indicated by the arrow B in the figure, and the angular displacement of operating shaft 17 is transmitted to the adjusting shafts 18 and 19 through the tension wire 21 such that the adjusting shafts 18 and 19 are also correspondingly erectly pivoted in the directions indicated by the arrows C and D, respectively.

FIG. 7 shows the expanded state of the multi-stage boom mechanism according to the above-mentioned operation in which the intermediate boom member 10 and the first boom member 11 are protruded to some extent where the operating shaft 17 is pivotably erected. In this state, the tilting angle $\alpha$ of the adjusting shaft 19 is adjusted in response to the protrusion amount of first boom member 11 according to the adjusted tilt angle of operating shaft 17 so that the tilting angle $\alpha$ is increased. Accordingly, the angle $\alpha$ defined between the first tension wire 23 and the adjusting shaft 19 is always adjusted identical to that of the tilting angle $\alpha$ defined between the first boom member 11 and the adjusting shaft 19.

By such operation, the chain of tension wires 21, 22 and 23 suspends upwardly a part of the weight load applied to the upper end of first boom member 11 to absorb the bending moment applied to the first and intermediate boom members 11 and 10 to thereby adjustably prevent the bending of first and intermediate boom members and 10. Accordingly, the first and intermediate boom members can maintain their linear alignment to thereby facilitate the smooth expansion and contraction movement relative to the last or base boom member 9.

Figure 8:
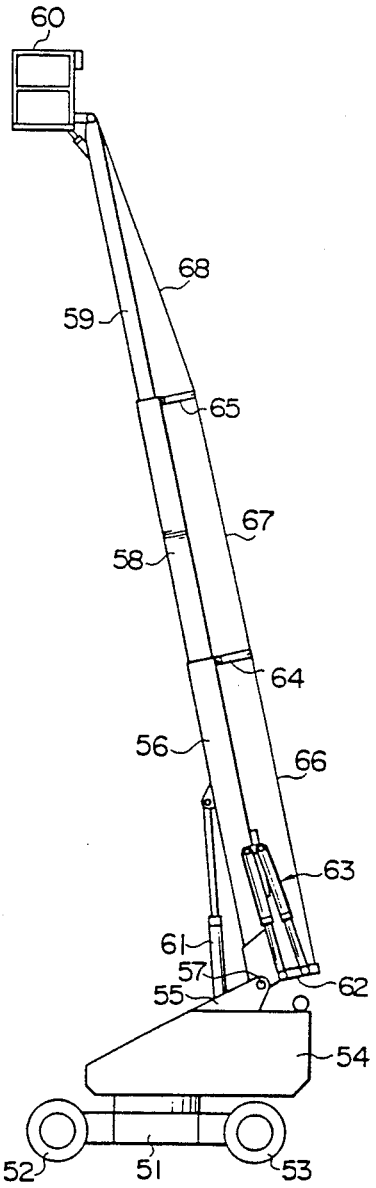
FIG. 8 is a side view showing an elevating working station vehicle provided with the multi-stage boom according to the present invention.

FIG. 8 shows an elevating or high working station vehicle provided with the inventive multi-stage boom mechanism for lifting workers and materials to a higher level. In this embodiment, front drive wheels 52 and rear drive wheels 53 are rotationally supported on a vehicle body 51 to freely drive the body 61. An operating body 54 is mounted on the vehicle body 51 turnably in horizontal plane.

A pair of support plates 55 having a triangle shape are mounted on the top side of operating body 54 in spaced relation from each other, and a bottom or last boom member 56 having rectangular shape in cross section is inserted between the pair of support plates 55 and is pivotably mounted up and down at its lower end portion to the operating body 54 through a pivot pin 57. An intermediate boom member 58 is inserted into an upper end opening of the last boom member 56, and a top or first boom member 59 is inserted into an upper end opening of the intermediate boom member 58. These last, intermediate and first boom members 56, 58 and 59 constitute a telescopic multi-stage boom mechanism. A bucket 60 is fixed to the upper end portion of first boom member 59 for accommodating therein persons and materials. In addition, a hydraulic cylinder 61 is interposed between the operating body 54 and the last boom member 56 to angularly elevate the multi-stage boom mechanism.

An operating shaft 62 is connected to the top side face of the lower end portion of last boom member 56, and a control mechanism 63 is connected to the operating shaft 62 to adjust the tilting angle thereof. An adjusting shaft 64 is connected to the top side face of the upper end portion of last boom member 56, and another adjusting shaft 65 is connected to the top side face of the upper end portion of intermediate boom member 58. A last tension wire 66 is extended between the operating shaft 62 and the adjacent adjusting shaft 64. An intermediate tension wire 67 is connected at its one end to the top portion of adjusting shaft 65, extended therefrom rearwardly, turned downward at the top portion of adjusting shaft 64, introduced into inside of the last boom member 56 through the upper end opening thereof, and connected at its other end to the lower end of the intermediate boom member 58 inside the last boom member 56. Further, a first tension wire 68 is connected at its one end to the upper end of first boom member 59, extended therefrom rearward, turned downward at the top portion of adjusting shaft 65, introduced into inside the intermediate boom member 58 through the upper end opening thereof, and is connected at its other end to the lower end of first boom member 59 inside the intermediate boom member 58.

In operation of the high working station vehicle, in response to the expansion of intermediate and first boom members 58 and 59 from the last boom member 56, the tension wires 67 and 68 are correspondingly and synchronizingly drawn from inside the boom members so as to suspend the weight load applied to the upper end of first boom member 59 to thereby prevent bending of the respective boom members 56, 58 and 59.

Figure 9:
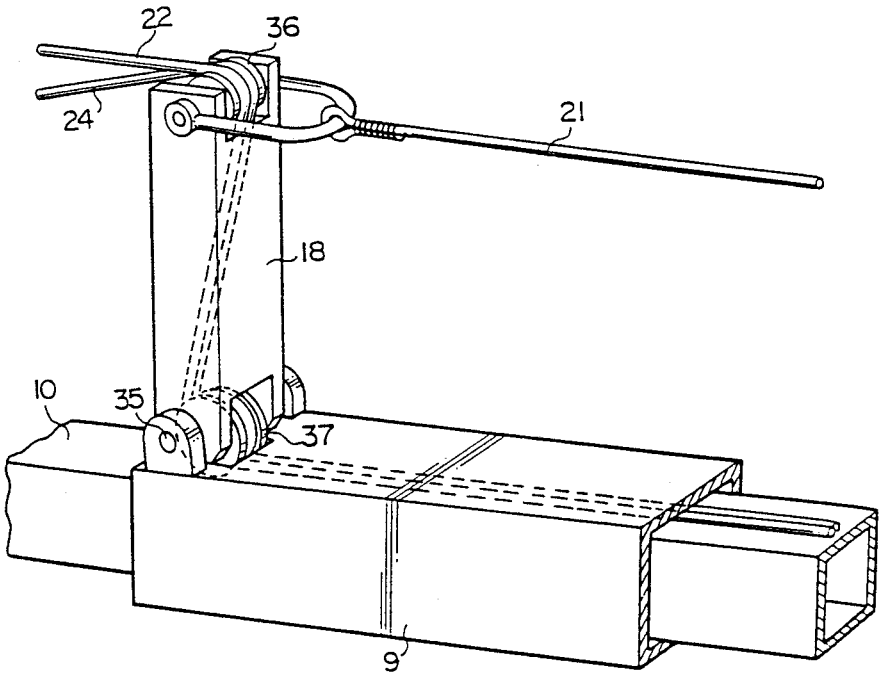
FIG. 9 is an enlarged perspective view showing another embodiment of the present invention.
Figure 10:
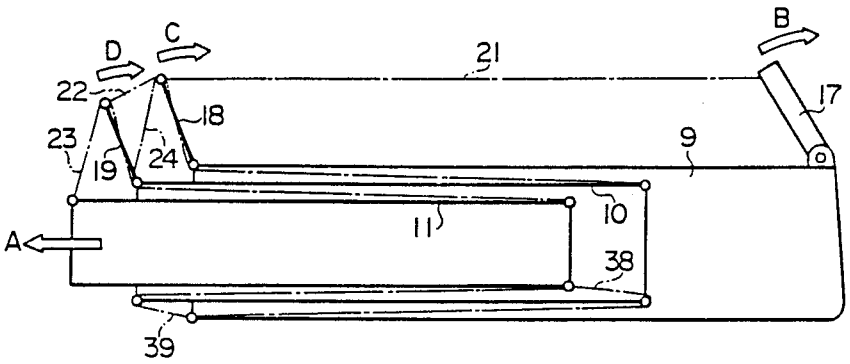
Figs. 10 and 11 are schematic views for illustrating the operation of said another embodiment.
Figure 11:
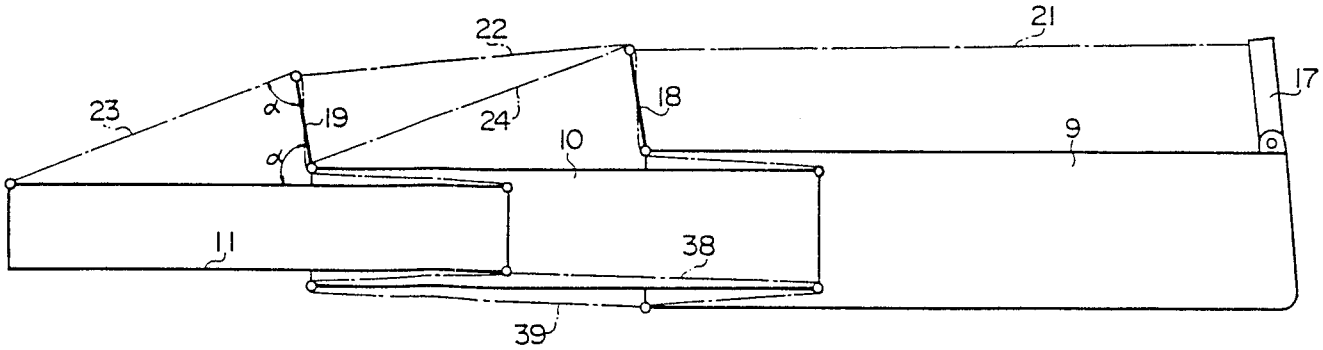

FIGS. 9, 10 and 11 show another embodiment of the multi-stage boom according to the present invention. The same reference numerals designate the same elements as in the embodiment shown in FIGS. 1~7. In this embodiment, another supplemental intermediate tension cable in the form of an additional wire 24 is connected at its one end to the bottom portion of adjusting shaft 19, extended therefrom rearwardly, then turned downward at the top portion of adjacent adjusting shaft 18 by means of a pulley 36 positioned at the top portion thereof, introduced and lead into the inside of the last boom member 9 through the upper end opening of last boom member 9, and finally connected at its other end to the lower end of intermediate boom member 10 inside the last boom member 9.

In operation, in response to the protrusion of intermediate boom member 10 from the last or base boom member 9, the additional wire 24 is drawn from inside the last boom member 9 in similar manner to the drawing of main intermediate tension wire 22. During the operation, the tilting angle of adjusting shafts 18 and 19 are adjusted according to the protrusion amount of intermediate boom member 10 to always equalize the length of wire 24 between the bottom portion of adjusting shaft 19 and top portion of adjusting shaft 18 to that of wire 22 between the top portion of adjusting shaft 19 and the top portion of adjusting shaft 18 to constitute an isosceles triangle with the wires 22, 24 and the adjusting shaft 19.

By such construction, the additional wire 24 cooperates with the corresponding intermediate tension wire 22 so as to pull upwardly the upper end portion of first boom member 11 and to reinforce the multi-stage boom mechanism.

As described above, according to the present invention, the tension wires are drawn from inside the respective boom members in response to the expansion of the multistage telescopic boom, and the tension angles thereof are always adjusted to effectively suspend a part of the weight load applied to the tip end of the multistage boom so as to absorb the bending stress applied to respective boom members to thereby prevent the bending of the boom. Accordingly, the axes of the individual boom members are always kept straight to facilitate the smooth sliding movement between the boom members. Moreover, the tension wires can suspend a part of the weight load to thereby reduce needed physical strength of each boom member, resulting in reduction of total weight of the multi-stage boom mechanism.

What is claimed is:

1. In a multi-stage boom having a plurality of boom members including a first boom member, at least one intermediate boom member and a last boom member, each boom member being slideably inserted into its subordinate boom member to undergo telescopic expansion and contraction, the improvement comprising: an operating shaft connected pivotably at its bottom portion erectly to a peripheral lower end portion of the last boom member; a plurality of adjusting shafts, each adjusting shaft being disposed pivotably at its bottom portion erectly to a peripheral upper end portion of respective ones of the boom members except the first boom member; a first tension cable connected at its one end to a lower end portion of the first boom member, lead thereform through an upper end opening of a subordinate boom member, turned forwardly at a top portion of the adjusting shaft disposed at a peripheral upper end portion of the subordinate boom member, and connected at its other end to an upper end portion of the first boom member; at least one intermediate tension cable connected at its one end to a lower end portion of a corresponding intermediate boom member, lead therefrom through an upper end opening of a subordinate boom member, turned forwardly at a top portion of the adjusting shaft disposed on a peripheral upper end portion of the subordinate boom member, and connected at its other end to a top portion of another adjusting shaft disposed on a peripheral upper end portion of the corresponding intermediate boom member; a last tension cable connected between a top portion of the operating shaft and a top portion of the adjusting shaft disposed on a peripheral upper end portion of the last boom member; and means for controlling a tilting angle of the operating shaft according to the expansion amount of the multi-state boom to tension a chain of the first, intermediate and last tension cables.

2. A multi-stage boom according to claim 1; including at least one supplemental tension cable, in combination with said one intermediate tension cable, connected at its one end to a lower end portion of a corresponding intermediate boom member, lead therefrom through an upper end opening of a subordinate boom member, turned forwardly at a top portion of the adjusting shaft disposed on a peripheral upper end portion of the subordinate boom member, and connected at its other end to a bottom portion of another adjusting shaft disposed on a peripheral upper end portion of the corresponding intermediate boom member.

3. A multi-state boom according to claim 1; including means operable to protrude the first boom member relative to an intermediate boom member and responsive to the means for controlling a tilting angle such that the tilting angle of the adjusting shaft disposed on an intermediate boom member next to the first boom member is controlled through the chain of tension cables so as to maintain the length of the first tension cable between the upper end portion of the first boom member and the top portion of said adjusting shaft the same as that of the protruded length of the first boom member.

4. A multi-stage boom according to claim 1; wherein the means for controlling a tilt angle comprises a plurality of controlling hydraulic cylinders controllable according to the expansion amount of the multi-stage boom and being connected between the last boom member and the operating shaft so as to pivot the operating shaft around its bottom portion.

5. A multi-stage boom according to claim 4; wherein said means includes a sliding member slideable along a top side face of the last boom member in the lengthwise direction thereof, the sliding member coupling at least a pair of controlling hydraulic cylinders, which are connected to the operating shaft in vertically spaced relation to each other, with the last boom member.

* * * * *